United States Patent [19]

Nitta et al.

[11] Patent Number: 4,989,646

[45] Date of Patent: Feb. 5, 1991

[54] PROFILED REED DENT WITH WEFT PASSAGE RECESS

[75] Inventors: Yoshio Nitta, Tokorozawa; Masayuki Muramatsu, Tokyo, both of Japan

[73] Assignee: Nissan Motor Co., Ltd., Yokohama, Japan

[21] Appl. No.: 389,595

[22] Filed: Aug. 4, 1989

[30] Foreign Application Priority Data

Aug. 16, 1988 [JP] Japan ..... 63-202760

[51] Int. Cl.[5] ..... D03D 47/30

[52] U.S. Cl. ..... 139/192; 139/435.5

[58] Field of Search ..... 139/435 D, 192, 435 E, 139/435.5

[56] References Cited

U.S. PATENT DOCUMENTS 3,818,952 6/1974 Vermeulen et al. ..... 139/435

4,328,842 5/1982 Scheffel ..... 139/435

4,478,259 10/1984 Honegger ..... 139/192

*Primary Examiner*—Andrew M. Falik

*Attorney, Agent, or Firm*—Foley & Lardner, Schwartz, Jeffery, Schwaab, Mack, Blumenthal & Evans

[57] ABSTRACT

In a weft insertion system of an air jet loom, a weft passage in the form of a U-shaped groove opening forwardly toward a cloth fell is formed by recesses of profiled reed dents, and sub-nozzles are arranged to direct auxiliary air jets into the weft passage. In order to obtain a desirable air stream in the weft passage, and to prevent a weft yarn from flying out of the passage, an upper edge of each recess, bordering the recess on the upper side, is inclined so that a distance from an axis of swing motion of the reed becomes gradually smaller toward the open end of the recess. Furthermore, an innermost edge of each recess is inclined so as to intersect at an angle with a straight line passing through the axis of swing motion.

8 Claims, 7 Drawing Sheets

PROFILED REED DENT WITH WEFT PASSAGE RECESS

BACKGROUND OF THE INVENTION

The present invention relates to a weft insertion system for an air jet loom, and more specifically to a weft insertion system having sub-nozzles for ejecting auxiliary air jets toward a weft passage formed in the reed.

FIG. 8 shows a conventional example. In this example, a reed 4 is swingable back and forth about an axis C of a sley word shaft 1. The reed 4 has profiled reed cents 5. Each of the profiled reed dents 5 is formed with a U-shaped recess 6 opening forwardly toward a cloth fell, and the U-shaped recesses are aligned to form a weft passage 7 extending in a weft inserting direction. Sub-nozzles 9 are arranged along the weft passage 7. In each dent, an upper edge 5A bordering the recess 6 on the upper side is sloping so that a distance R1 of an outer end X of the upper edge from the axis C of the sley sword shaft 1 is smaller than a distance R2 of an inner end of the upper edge 5A. This configuration helps a weft yarn in flying properly in the weft passage. A similar weft passage is shown in a Japanese Patent Provisional Publication No. 57-143544.

However, this configuration of the weft passage is still unsatisfactory. The auxiliary air jet of each sub-nozzle bumps against the innermost edges 5B of the recesses 6, and forms an air stream carrying the weft yarn along the weft passage. In general, the weft insertion starts when the reed 4 is in a backward motion, and terminates when the reed is in a forward motion. When the reed 4 :s moving backwards away from the cloth fell, an air stream in the weft passage tends to be left behind and to separate from the weft passage. The configuration of upper edges 5A of the weft passage 7, and the auxiliary air jets of the sub-nozzles 9 both contribute to decrease of this undesired tendency, and prevention of the weft yarn from flying out of the weft passage. Therefore, the auxiliary air jets must be made stronger than the level required for carrying the weft yarn, in order to press the weft yarn in the weft passage.

FIG. 9 shows a pressure distribution in the U-shaped recess 6. Curved lines in the recess 6 are isobaric lines connecting equal air pressure points in a weft passage section which is a predetermined distance apart from one of the sub-nozzle 9. A highest pressure point HP at which the pressure is highest in the recess 6 is located at a relatively shallow position whose distance $l_1$ from the open end of the recess 6 is relatively short. Generally, the weft yarn flies near the highest pressure point HP. Therefore, in the weft passage of this configuration, the flight course of the weft yarn is so shallow that the weft yarn tends to deviate from the weft passage. The conventional configuration of the weft passage is, therefore, still unsatisfactory in that the tendency to derailment of a weft yarn is relatively high, and a large air consumption is entailed to prevent such derailment.

SUMMARY OF THE INVENTION

It is therefore an object of the present invention to provide a mechanism of an air jet loom which can decrease the tendency to deviation of a weft yarn from a weft passage, without increasing the air consumption so much.

According to the present invention, a mechanism for an air jet loom, comprises a reed which is swingable back and about a swing axis, such as the axis of a sley sword shaft. The reed comprises a plurality of profiled dents each of which is formed with a recess. The dents are arranged so that the recesses form a weft passage. Each of the recesses is defined by an upper edge, a lower edge and an inner edge which extends between the upper and lower edges. The upper edge of each profiled dent is so shaped that a first distance from the swing axis to a predetermined outer point lying on the upper edge is smaller than a second distance from the swing axis to a predetermined inner point which lies on the upper edge and which is closer to the inner edge than the outer point. The inner edge of each profiled dent is inclined so that the inner edge intersects at a predetermined angle with a straight line passing through the swing axis.

In some embodiments of the invention, a line along which the inner edge extends is substantially perpendicular to a line along which the upper edge extends.

In the weft passage of the present invention, the center of the air stream is located at a deeper position in the weft passage. Therefore, the present invention can decrease the tendency to a swerving flight of a weft yarn, and prevent an excessive increase of the air consumption for the sub-nozzles.

BRIEF DESCRIPTION OF THE INVENTION

DETAILED DESCRIPTION OF THE INVENTION

Figure 1:
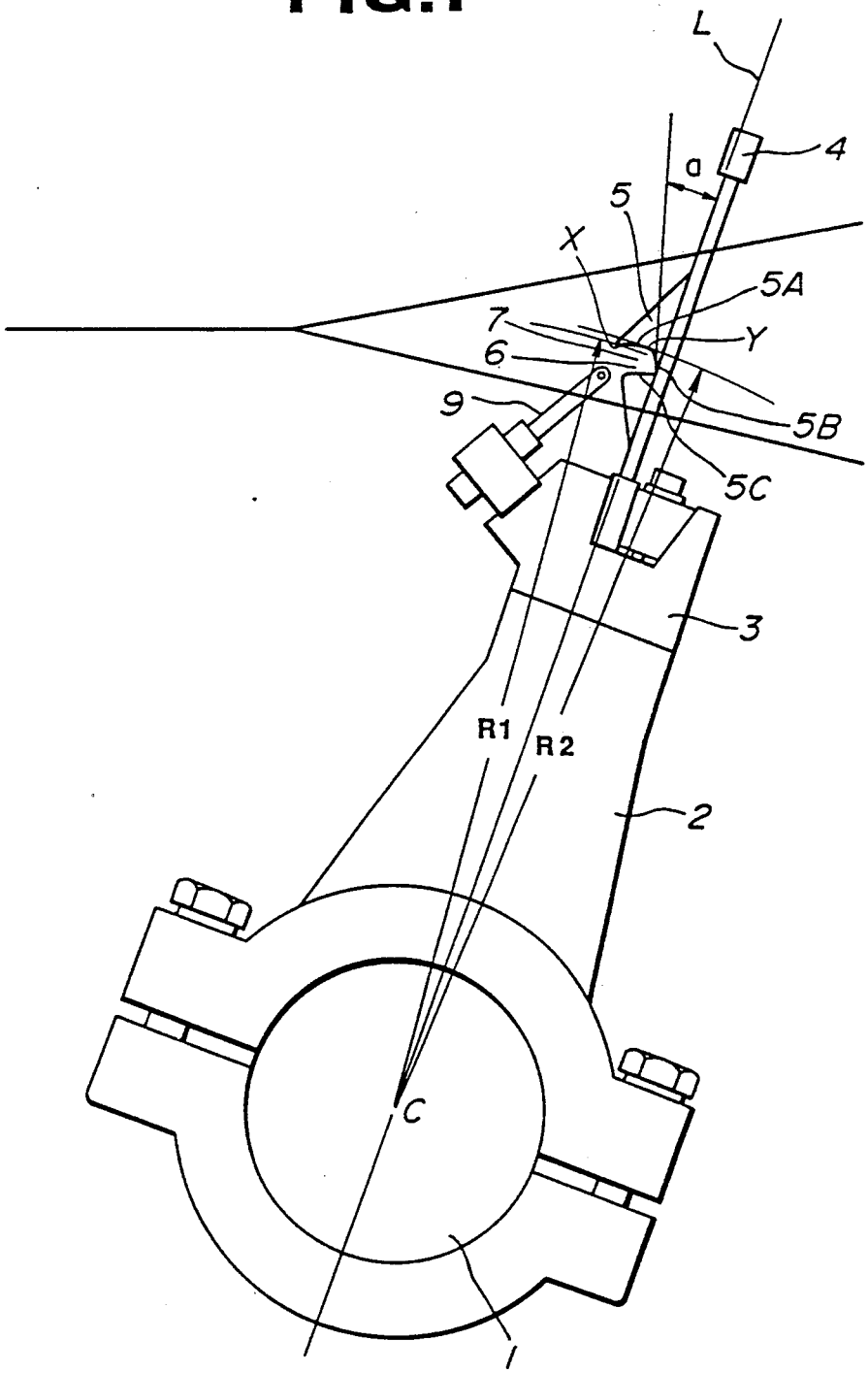
FIG. 1 is a side view showing a mechanism according to a first embodiment of the present invention.
Figure 2:
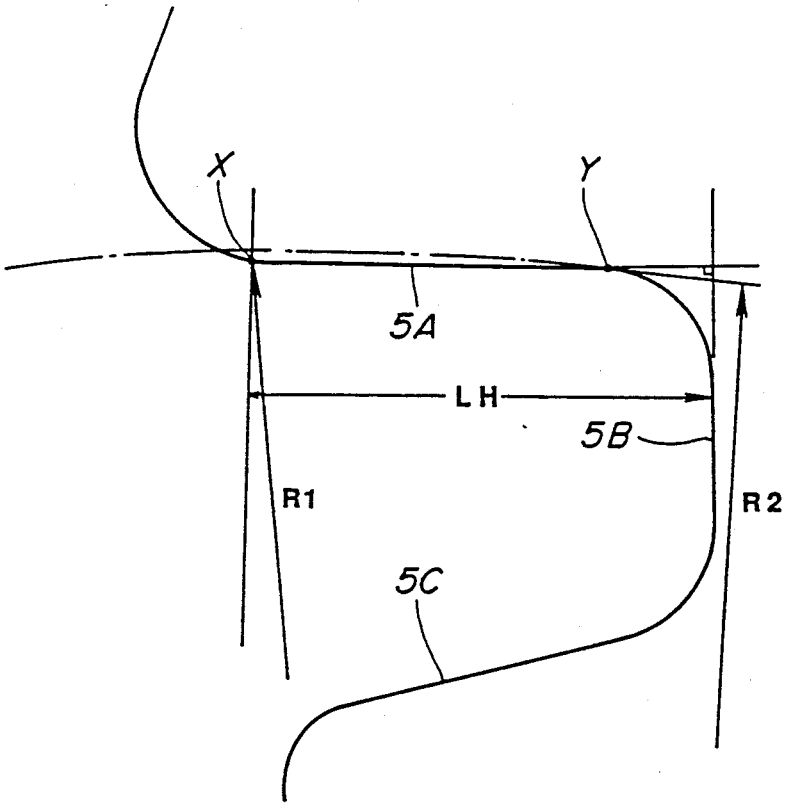
FIG. 2 is an enlarged view showing a U-shaped recess of a profiled reed dent of the first embodiment.

A first embodiment of the present invention is shown in FIGS. 1 and 2. A plurality of sleys 2 are fixedly mounted on a sley sword shaft 1 at predetermined intervals, and a reed holder 3 is fixed on upper ends of the sleys 2. A reed 4 is firmly held by the reed holder 3. The reed 4 swings back and forth about an axis of the sley sword shaft 1.

The reed 4 has a plurality of profiled reed dents 5 each of which is formed with a profiled recess 6. The reed dents 5 are regularly arranged, and the recesses 6 are aligned so as to form a weft passage 7 extending along a weft inserting direction. The weft passage 7 is in the form of a U-shaped groove opening forwardly toward a cloth fell located ahead of the reed 4. The weft passage 7 extends along the weft inserting direction from a weft inlet end located on a weft inserting side of the loom, to a weft outlet end located on a weft receiving side opposite to the weft inserting side.

Figure 7:
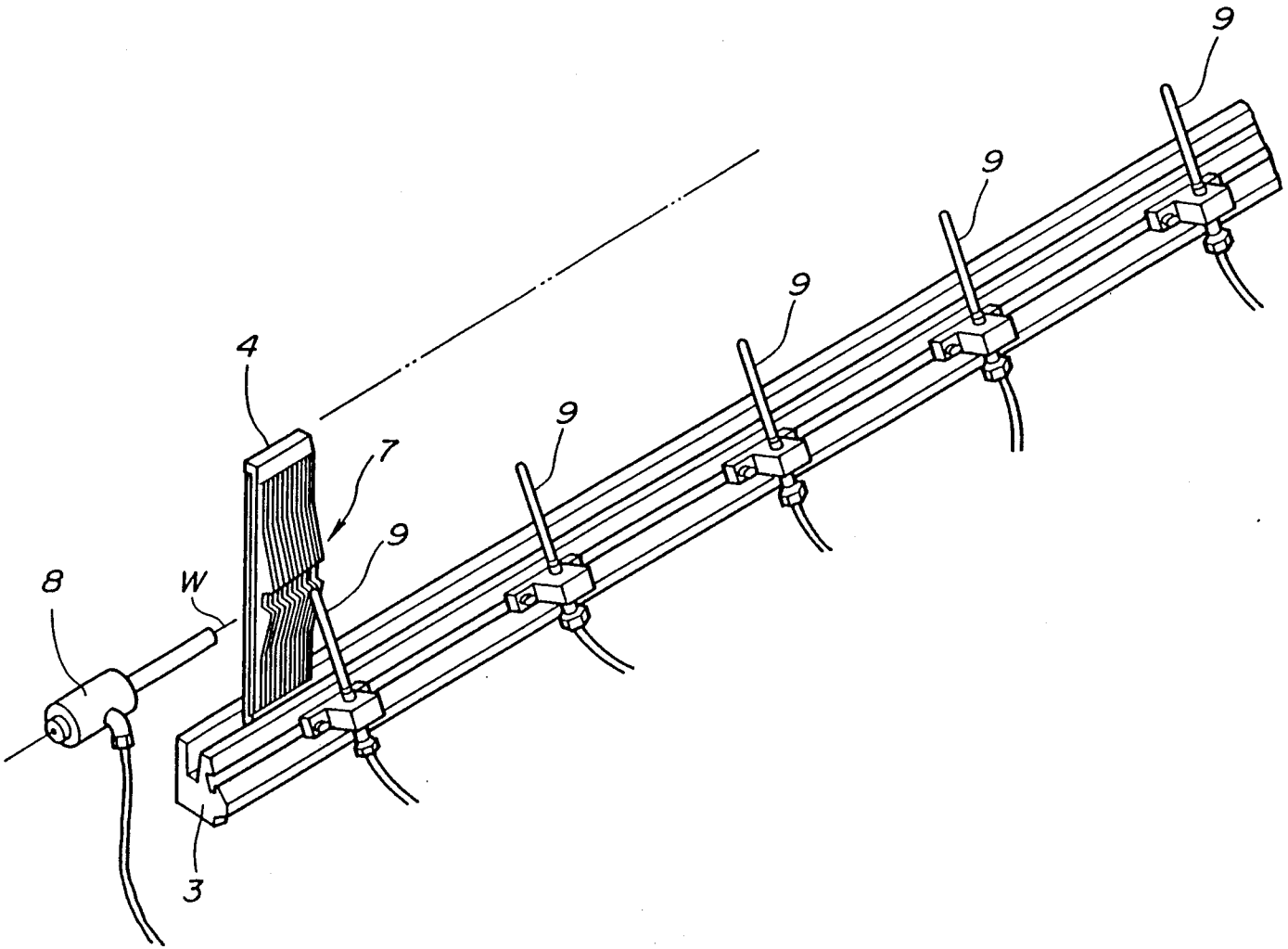
FIG. 7 is a perspective view showing an arrangement of a reed, a main nozzle and sub-nozzles, employed in each preceding embodiment of the invention.
Figure 8:
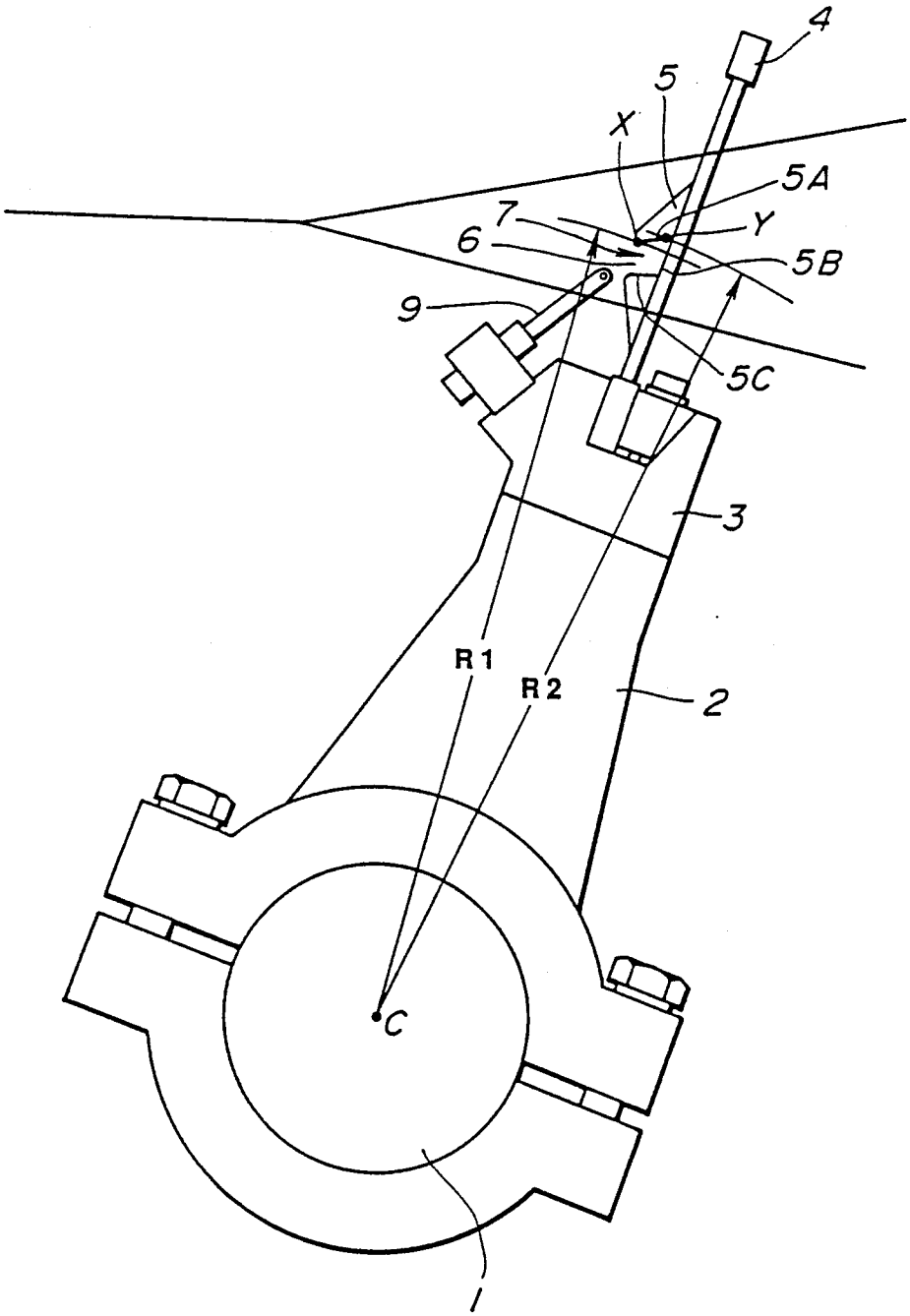
FIG. 8 (PRIOR ART)
FIG. 8 is a side view showing a conventional mechanism.

As shown in FIG. 7, the weft insertion system of this embodiment further includes a main air jet nozzle 8, and a plurality of sub-nozzles 9. The main nozzle 8 is disposed on the weft inserting side of the weft passage 7, and aimed at the weft inlet end of the weft passage 7. The sub-nozzles 9 are fixedly supported on a front side of the reed holder 3. The sub-nozzles 9 are arranged at predetermined intervals along the weft passage 7, and designed to eject auxiliary air jets obliquely toward the weft passage 7.

In this weft insertion system of the multi-nozzle type, the main nozzle 8 ejects a weft yarn W into the weft passage 7 from the weft inlet in, and the sub-nozzles 9 propel the forward end of the weft yarn W to the weft outlet end of the passage 7, by ejecting auxiliary jets in regular sequence.

Each of the profiled recesses 6 of the reed dents 5 is bounded on the upper side by an upper edge 5A, on the innermost side by an inner edge 5B, and on the lower side by a lower edge 5C. The upper and lower edges 5A and 5C extend generally horizontally, and the inner edge 5B extends generally vertically from an inner end of the upper edge 5A to an inner end of the lower edge 5C. Thus, the upper and lower edges 5A and 5C and the inner edge 5B form a U shape which is laid down, and opens horizontally.

The upper edge 5A of each profiled dent 5 is shaped so as to satisfy the following relationship. As shown in FIGS. 1 and 2, an outer point X is a predetermined point lying on the upper edge 5A near the open side of the recess 6. A inner point Y is a predetermined point lying on the upper edge 5A near the inner edge 5B. The outer point X is remoter from the inner edge 5B than the inner point Y. A first distance (radius) R1 is a distance between the outer point X and the axis C of the sley sword shaft 1. A second distance (radius) R2 is a distance between the inner point Y and the axis C of the sley sword shaft 1. In the upper edge 5A of each profiled dent 5 of this embodiment, the first distance R1 is smaller than the second distance R2 (R1<R2).

Moreover, the inner edge 5B of each profiled dent 5 of this embodiment is inclined with respect to a straight line L passing through the axis C of the sley sword shaft 1, and forms a predetermined angle "a" with the straight line L. In other words, the inner edge 5B of each profiled dent 5 has an inclined portion having a narrow flat wall surface which intersects a flat plane containing the axis C of the slay sword shaft 1, at the angle "a". The upper end of the inclined portion is located ahead of the flat plane, on the front side of the flat plane on which the cloth fell lies, and the lower end of the inclined portion is located on the rear side of the flat plane opposite to the front side.

The upper edges 5A forming an upper surface of the weft passage 7 slope down from the inner side toward the open side so that the distance from the axis C of the spring motion of the reed 4 becomes smaller toward the open side of the U-shaped of the weft passage 7. Therefore, the upper edges 5A acts so as to confine an air stream in the weft passage 7, and to prevent the air stream from escaping from the open side especially when the reed 4 is moving backwards in the first half of the weft insertion period. Thus, the upper edges 5A make it difficult for the weft yarn W to fly out of the weft passage 7.

Figure 3:
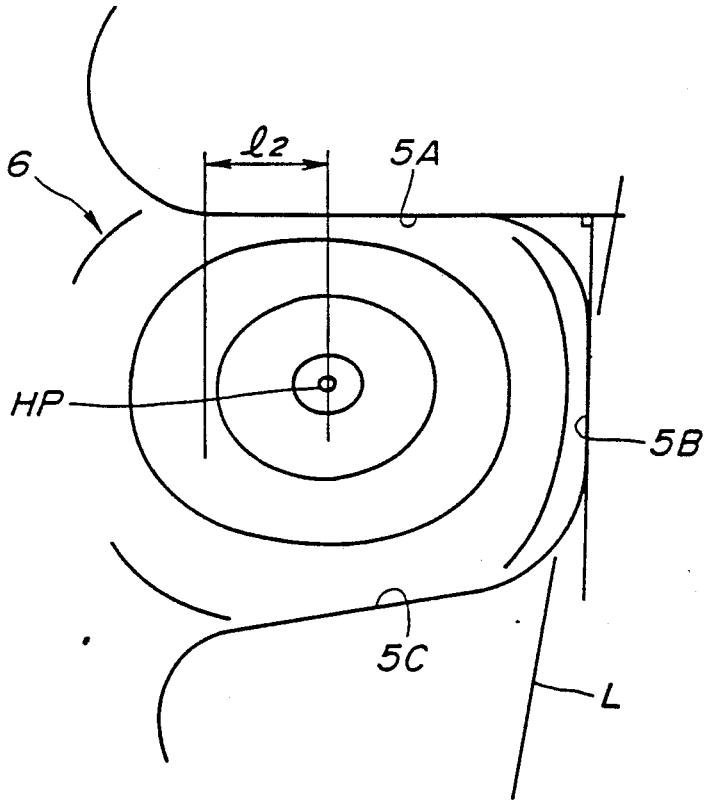
FIG. 3 is an isobaric chart showing a pressure distribution in the recess of the first embodiment.
Figure 9:
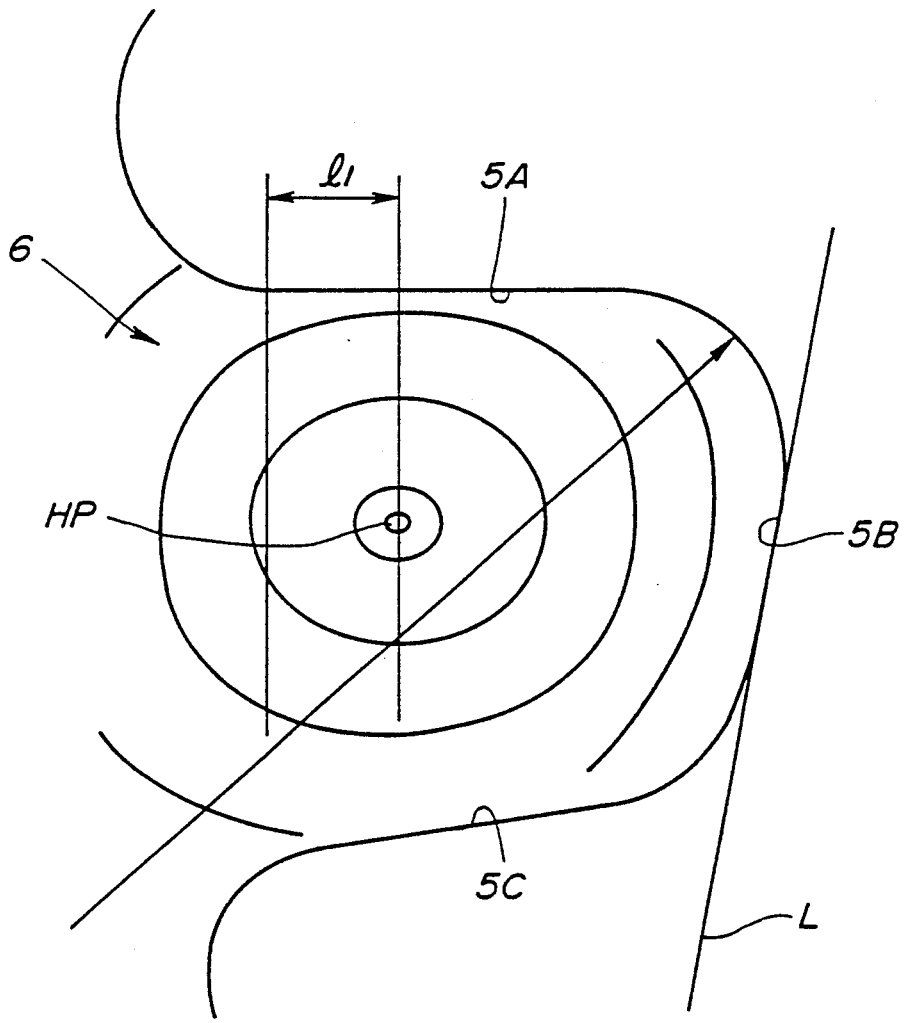
FIG. 9 (PRIOR ART)
FIG. 9 is an isobaric chart showing a pressure distribution in the conventional mechanism.

The inner edges 5B of this embodiment also contribute to the prevention of weft yarn's deviation from the weft passage 7. The inner edges 5B leaning toward the open side of the passage 7 with respect to the straight line L, exert influence on a pressure distribution in the weft passage 7. FIG. 3 shows a pressure distribution obtained in the weft passage 7 of the first embodiment. As shown by isobars of FIG. 3, a highest pressure point HP at which the pressure is highest, is closer to the inner edge 5B of the weft passage, and remoter from the open end of the weft passage than the highest pressure point obtained by the conventional profile of the weft passage. A distance $\mathbf{1}_2$ of the highest pressure point HP from the open end of the recess 6 shown in FIG. 3 is longer than the distance $\mathbf{1}_1$ in the conventional weft passage shown in FIG. 9. Therefore, it is possible to keep the flight course of the weft yarn W deeper in the weft passage 7 from the open side without increasing the air jet pressure of the sub-nozzles 9.

In the first embodiment, the inner edge 5B of each recess 6 is substantially perpendicular to the upper edge 5A. In a weft passage in which the angle formed between the upper and inner edges 5A and 5B is an acute angle, the pressure decreases abruptly at the corner between the upper and inner edges 5A and 5B, so that the force pushing the weft yarn toward the wall surface is weakened abruptly. Such an abrupt decrease of the pressure is prevented in the weft passage 7 of this embodiment which has no acute corner. In the first embodiment, each of the upper, inner and lower edges 5A, 5B and 5C is substantially straight, but the upper corner between the upper and inner edges 5A and 5B and the lower corner between the inner and lower edges 5B and 5C are both rounded, as shown in FIG. 2. A distance LH shown in FIG. 2 is a distance between the outer point X of the upper edge 5A and the flat plane in which the inner edge 5B lies. The point X is a point at which the distance from the axis C of the sley sword shaft 1 is minimum. It is preferable, according to experimental results, to make the distance LH equal to 7–13 mm.

In this way, the upper edges 5A of the first embodiment have wall surfaces lie in a generally horizontal flat plane, and the inner edges 5B have wall surfaces lie in a generally vertical flat plane, which is substantially perpendicular to the generally horizontal plane. In this embodiment, the lower edges 5C have wall surfaces extending in a flat plane which intersects with the vertical plane in which the inner edges 5B extend, at an angle which is equal to or greater than about 90°.

Figure 4:
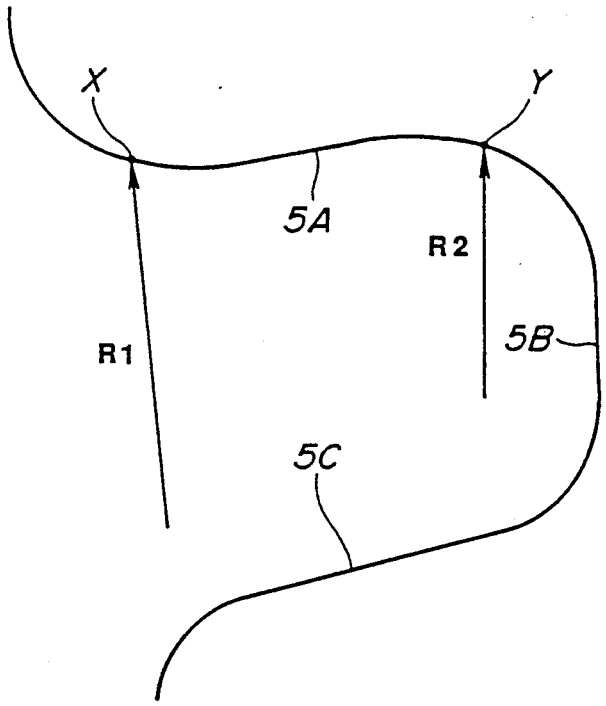
FIG. 4 is an enlarged view of a recess for showing a second embodiment of the present invention.

A second embodiment of the present invention is shown in FIG. 4. The weft inserting mechanism of the second embodiment is almost the same as that of the first embodiment, and different only in the following point. In the second embodiment, the upper edge 5A of each profiled dent 5 is not flat, but slightly curved. Effects obtained by the weft passage of the second embodiment are substantially the same as those of the first embodiment.

Figure 5:
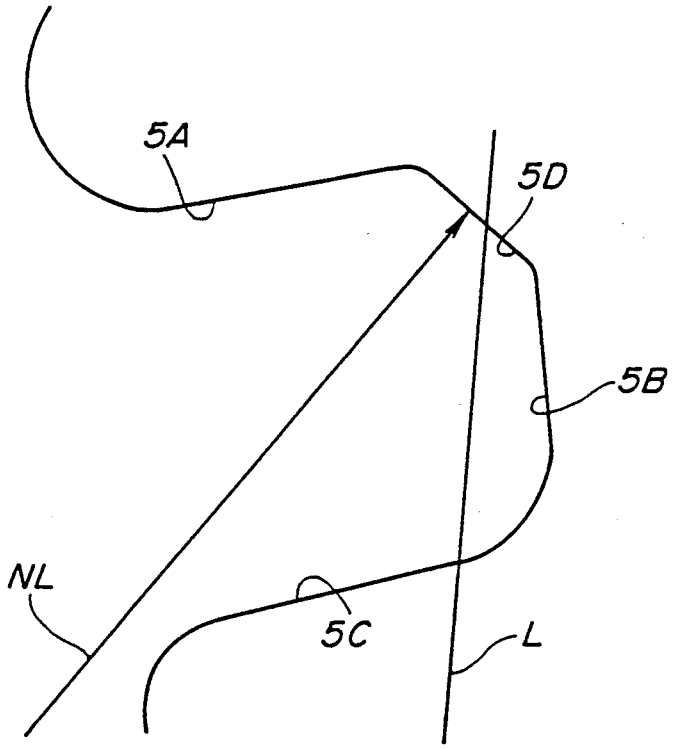
FIG. 5 is an enlarged view of a recess according to a third embodiment of the invention.

FIG. 5 shows a third embodiment of the present invention. In the third embodiment, the inner edge 5B of each dent 5 has an inclined upper portion 5D and a lower portion extending downwardly from a lower end of the upper portion 5D. The upper portion 5D of the inner edge is substantially flat, and inclined so that a straight line NL showing the direction of the auxiliary jet of one of the sub-nozzles 9 is substantially perpendicular to the upper portion 5D of the inner edge 5B. The auxiliary jet is ejected upwardly and obliquely toward the inclined upper portions 5D of the inner edges 5B along a straight line lying on the inclined plane passing through the line NL and extending in parallel to the weft inserting direction. The lines along which the auxiliary jets are ejected by the sub-nozzles 9 lie generally on the same flat plane which intersects the flat wall surfaces of the upper portions 5D of the inner edges 5B, substantially at right angles. The distance R1 is smaller than R2 as in the first embodiment, and the straight line L intersects the upper portion 5D of the inner edge 5B as shown in FIG. 5. The upper portions 5D act to prevent the deviation of the weft yarn from the weft passage 7 by preventing a circulating flow from being formed in the passage 7.

Figure 6:
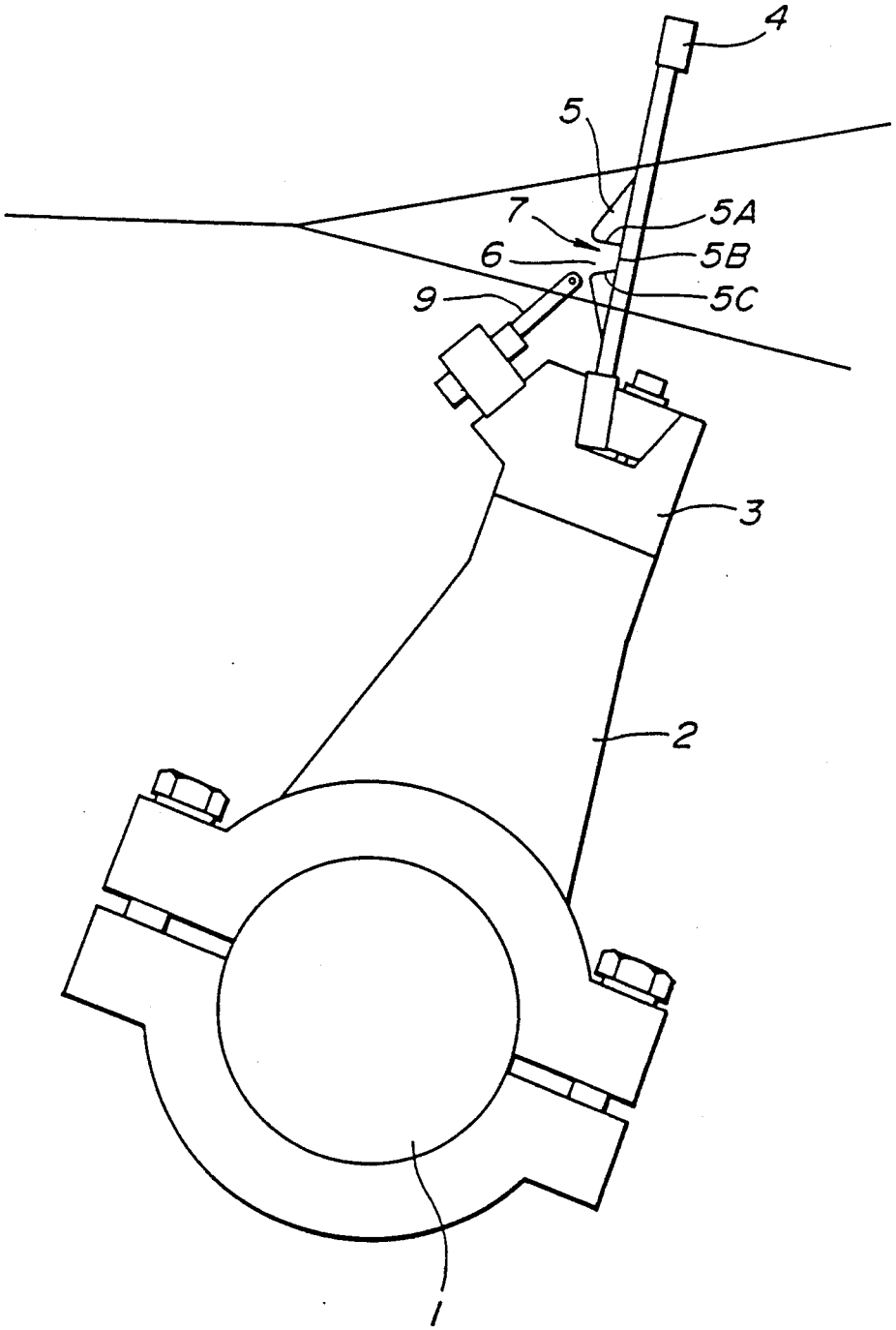
FIG. 6 is a side view showing a mechanism of a fourth embodiment of the invention.

A fourth embodiment of the present invention is shown in FIG. 6. In the fourth embodiment, the reed 4 leans forwardly toward the cloth fell, and is fixed, in the leaning posture, to the reed holder 3 so as to satisfy the conditions required in the present invention. The angle between the upper and inner edges 5A and 5B is a right angle or an obtuse angle. In the fourth embodiment, it is not necessary to incline the inner edges 5B with respect to the reed 4 or the straight rear sides of the dents 5. The reed 4 itself is inclined with respect to the sleys, 2 and the reed holder 3 by the shape of one or more wedge members which are forced in a groove formed in the top of the reed holder 3 together with the lower end of the reed 4, as shown in FIG. 6. In all the illustrated embodiments, the reed 4 has an upper frame member holding the upper ends of the reed dents 5, and a lower frame member which holds the lower ends of the reed dents 5, and which is fixed to the reed holder 3. In each dent 5, the recess 6 is formed in the front side, and the rear side of each dent is straight.

As explained above, the weft insertion system of the present invention can prevent deviation of weft yarn from the weft passage without increasing the air consumption, so that it is advantageous in efficiency and energy saving.

What is claimed is:

1. A mechanism for an air jet loom, comprising;

a reed swingable back and forth on a predetermined swing axis, said reed comprising a plurality of profiled dents each of which is formed with a recess, said profiled dents being arranged so that said recesses form a weft passage, each of said recesses being defined by an upper edge, a lower edge and an inner edge extending between said upper and lower edges, said upper edge of each profiled dent being so shaped that a first distance from said swing axis to an outer point lying on said upper edge is smaller than a second distance from said swing axis to an inner point which lies on said upper edge and which is closer to said inner edge than said outer point, said inner edge of each profiled dent intersecting at a predetermined angle with a straight line passing through said swing axis.

2. A mechanism according to claim 1 wherein said inner edge of each profiled dent extends along a line which is substantially perpendicular to a line along which said upper edge extends.

3. A mechanism according to claim 1 wherein said upper and inner edges of each profiled dent extend, respectively, along straight lines which intersect with each other at an angle which is equal to or greater than approximately 90 degrees.

4. A mechanism according to claim 1 further comprising sub-nozzles arranged along said weft passage for ejecting auxiliary air jets into said weft passage.

5. A mechanism according to claim 4 wherein at least one of said sub-nozzles is arranged to eject the auxiliary jet along a straight line which lies in an inclined plane, and said inner edge of each profiled dent comprises an upper portion having a wall surface substantially perpendicular to said inclined plane.

6. A mechanism according to claim 4 further comprising a sley sword shaft on which said reed is swingable, and a reed holder fixed to said sley sword shaft, for holding said reed.

7. A mechanism according to claim 6 wherein said reed is fixed to said reed holder so that each of said profiled dents extends from a lower end to an upper end along a straight line which is inclined with respect to a plane containing said swing axis and said lower end of said profiled dent.

8. A mechanism according to claim 1 wherein each of said profiled dents of said reed has a front surface facing toward a position of a cloth fell, and each of said recesses is formed in said front surface of one of said profiled dents and opens toward the position of a cloth fell.

* * * * *